US007086423B2

(12) United States Patent
Keller et al.

(10) Patent No.: US 7,086,423 B2
(45) Date of Patent: Aug. 8, 2006

(54) PILE FABRIC

(75) Inventors: Michael Keller, Simpsonville, SC (US); Andre M. Goineau, Spartanburg, SC (US); Robert S. Brown, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 317 days.

(21) Appl. No.: 10/438,497

(22) Filed: May 15, 2003

(65) Prior Publication Data

US 2004/0244863 A1 Dec. 9, 2004

(51) Int. Cl.
*D03D 39/16* (2006.01)

(52) U.S. Cl. ..... 139/21; 139/383 R; 139/116.5; 139/391; 139/394; 139/402

(58) Field of Classification Search ..... 139/383 R, 139/2, 21, 37, 102, 391, 392, 394, 116.5, 139/399, 402
See application file for complete search history.

(56) References Cited

U.S. PATENT DOCUMENTS 3,241,509 A * 3/1966 Short ..... 112/410
3,999,940 A * 12/1976 Freeman ..... 8/449
4,600,644 A 7/1986 Bromley et al.
5,139,725 A 8/1992 Specker et al.
5,501,891 A * 3/1996 Saika et al. ..... 428/71
5,611,127 A 3/1997 Ceriani et al.
5,953,783 A * 9/1999 Hahn ..... 15/167.1
5,983,470 A 11/1999 Goineau
5,997,980 A * 12/1999 Matoba et al. ..... 428/85
6,605,332 B1 * 8/2003 Calhoun et al. ..... 428/91

OTHER PUBLICATIONS

Article "Crimping Fibers," pp. 24-30, Publication unknown.
Article "The Kawabata System for the Standardization and Analysis of Hand Evaluation," Publication unknown.

* cited by examiner

*Primary Examiner*—John J. Calvert
*Assistant Examiner*—Robert H Muromoto, Jr.
(74) *Attorney, Agent, or Firm*—Terry M. Moyer; Robert M. Lanning

(57) ABSTRACT

A pile fabric such as may be used in automotive and furniture upholstery and other applications which fabric incorporates a pile surface formed from variable height fibers. The pile is made up of a first group of fibers having a first height and at least a second group of fibers having a second height which is on average less than the height of the first group. A method of formation is also provided.

42 Claims, 8 Drawing Sheets

FIG. —1—

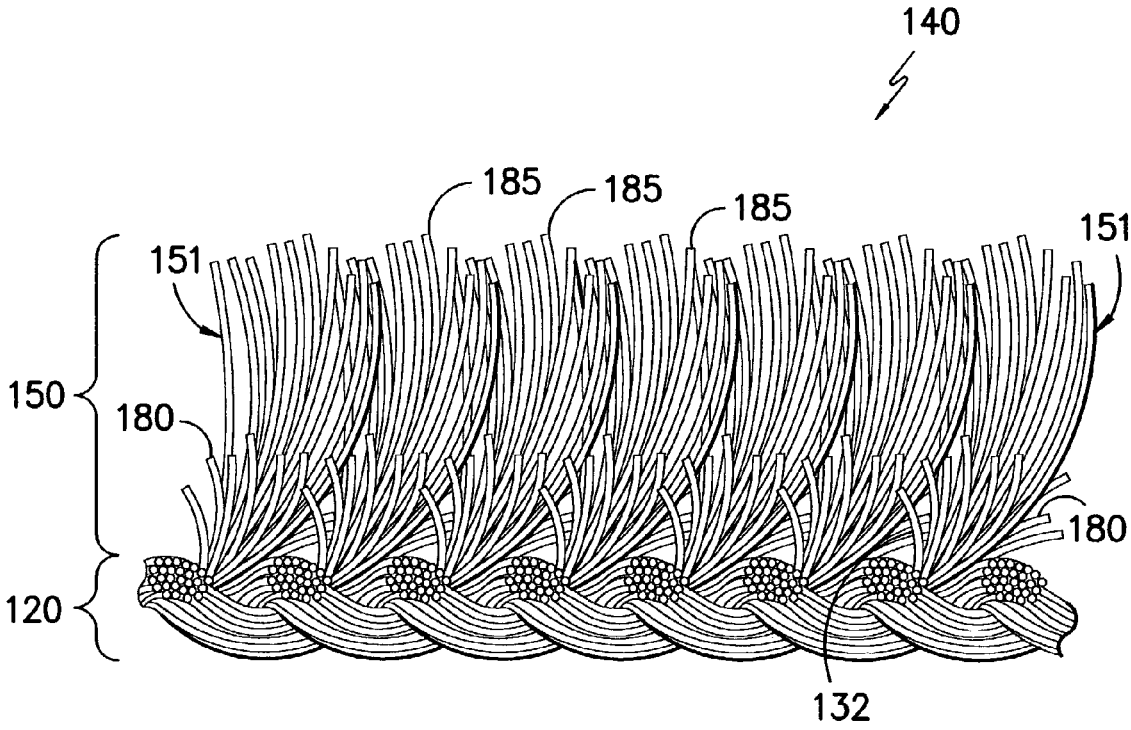
FIG. –5–

PILE FABRIC

FIELD OF THE INVENTION

The present invention is directed to a pile fabric of plush character adaptable for use in surface covering applications. More particularly, the invention relates to a pile fabric including an outwardly projecting pile portion formed from a multiplicity of multi-filament yarns.

BACKGROUND OF THE INVENTION

Pile fabrics such as velours, velvets, and the like are generally known. Such fabrics are typically formed using a sandwich method in which two fabrics are woven or knitted in face to face relation with the pile ends interlocking. A blade is used to slit through the pile ends to produce two separate pieces of fabric such that a multiplicity of yarns project outwardly away from the base so as to define a user contact surface. A common application for pile fabrics is in the covering of seating structures and other interior components for use within transportation vehicles including automobiles, trains, aircraft and the like. Such fabric is also typically used in the manufacture of standard furniture.

As will be appreciated, in forming a pile fabric around portions of a seating structure, the fabric will be caused to bend around various sharp radius portions of the surface being covered. Such bending typically causes the pile-forming yarns to spread apart thereby exposing a portion of the underlying base fabric. That is, the bending causes a visually perceptive break in the surface coverage provided by the pile yarns. Such a break in surface coverage may be aesthetically displeasing and thus undesirable.

In some instances, in order to promote the uniformity of surface coverage around a sharp bend radius it may be possible to utilize extremely high pile density across the base fabric. However, such high pile densities may not be completely effective in the avoidance of pile separation and tend to add substantial cost and weight to the fabric.

Another potential solution is to utilize so-called (textured) pile yarns across the fabric. Such textured yarns are subjected to processes such as false twisting and the like so as to impart a textured irregular surface character along the length of the filaments within the yarns so as to bulk the filaments along their length. Thus the original substantially uniform character of the filaments within the yarns is substituted with an irregular random character. While such textured yarns may provide beneficial surface coverage characteristics, they may pose problems in fabric manufacture while also adding complexity and expense due to the texturizing processes required. In addition, use of such textured yarns may give rise to an enhanced potential for the occurrence of single end defects and nonuniformity in dyeing.

SUMMARY OF THE INVENTION

The present invention provides advantages and alternatives over the prior art by providing a pile fabric such as may be used in automotive and furniture upholstery applications which fabric incorporates a pile surface formed from variable height pile-forming fibrous elements.

According to one aspect of the invention the pile portion of the fabric is made up of a multiplicity of yarn tufts. At least a portion of the yarn tufts include a first group of pile-forming fibrous elements having a first height and at least a second group of pile-forming fibrous elements having a second height which is on average greater than the height of the first group.

In one particular embodiment, for example, on average, the height of the first group of pile-forming fibrous elements is at least about 25% less (and may be about 30%–45% less) than the height of pile-forming fibrous elements in the second group. The first (shorter) group of pile-forming fibrous elements defines a cooperative covering for the base of the pile fabric. The second (longer) group of pile-forming fibrous elements defines a dispersed upper contact surface imparting a soft feel to the user (i.e. low friction and high compressibility).

Thus, within the tufts the population density of pile-forming fibrous elements is characterized by at least two defined stages along the length of the tufts such that a first portion of the tufts adjacent the base of the fabric has a greater intra-tuft population density of pile-forming fibrous elements than the portion of the yarn tufts at the upper portion of the pile. The yarns making up the pile are preferably flat (i.e. untextured) yarns and may be characterized by a substantially uniform cross-sectional configuration along their length. The cross-sectional configuration may be round or some other appropriate yarn configuration such as a lobal wave cross-section or the like as will be well known to those of skill in the art.

In addition to being different heights, the tufts are also preferably substantially bloomed in a lateral direction. Such blooming reduces the void area between the tufts across the base thereby further improving surface coverage.

BRIEF DESCRIPTION OF THE DRAWINGS

The present invention will now be described by way of example only, with reference to the accompanying drawings which constitute a part of this specification herein and in which:

FIG. 5 is a cut-away illustration of an exemplary pile fabric in accordance with the present invention wherein the fibers within the pile are of variable height and bloomed to provide enhanced surface coverage across the base;

While the invention has been illustrated and will hereinafter be described in connection with certain potentially preferred embodiments and practices, it is to be understood that in no event is the invention to be limited to such illustrated and described embodiments and practices. On the contrary, it is intended that the invention shall extend to all alternatives and modifications as may embrace the broad principles of the invention within the true spirit and scope thereof.

DESCRIPTION OF EMBODIMENTS

Figure 1:
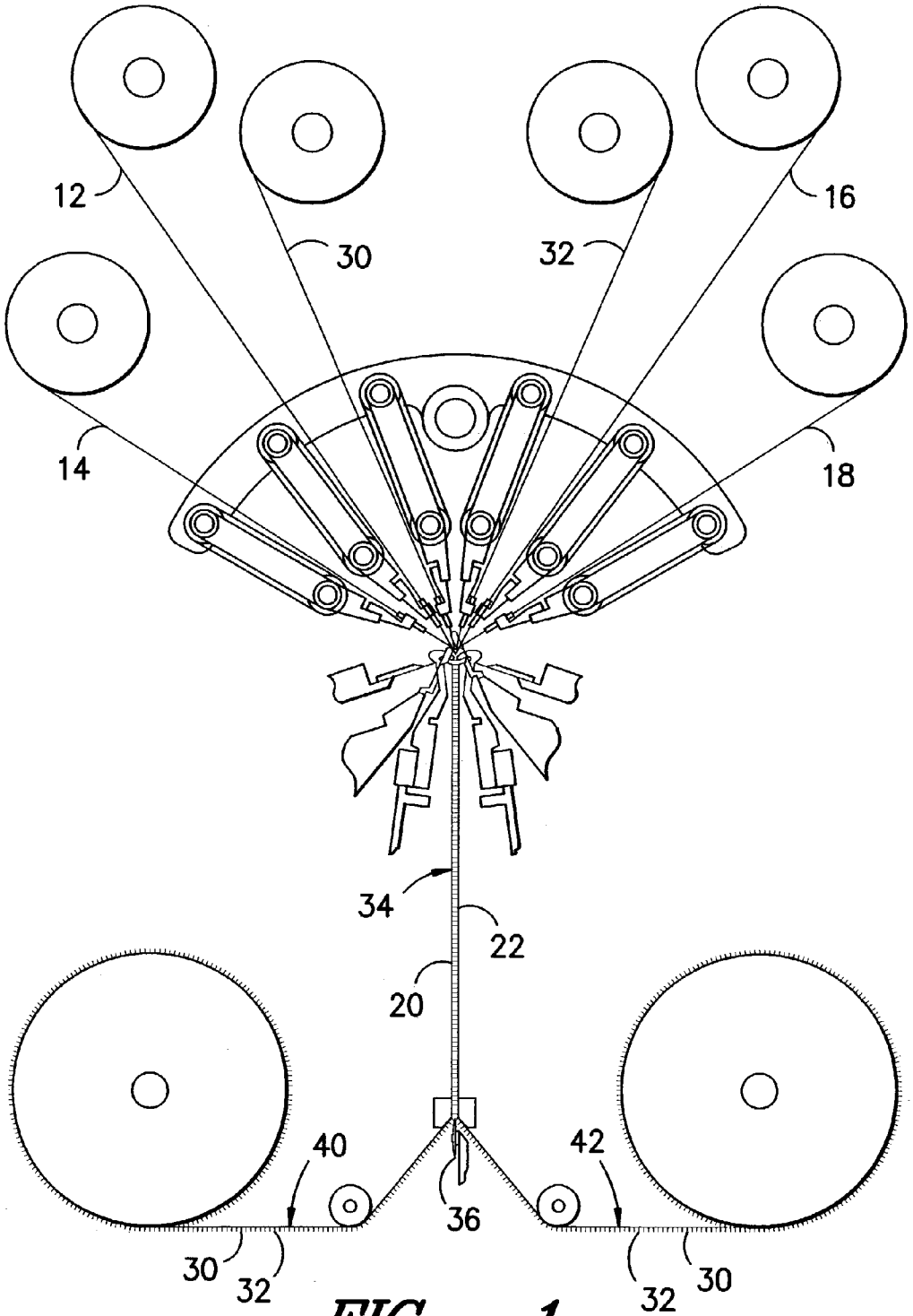
FIG. 1 is a schematic illustrating an exemplary construction practice for formation of a pile fabric.

Reference will now be made to the several figures wherein to the extent possible the same reference numerals have been used to describe the same feature, material, or relationship. In FIG. 1, there is illustrated schematically a pile fabric formation apparatus 10 such as a double needle bar knitting machine as will be well known to those of skill in the art.

As illustrated, in operation of the fabric formation apparatus 10 a first pair of cooperating ground yarns 12, 14 and a second pair of cooperating ground yarns 16, 18 are delivered into opposing relation and are formed into a pair of opposing base or ground fabrics 20, 22. Concurrently, with the formation of the base fabrics 20, 22 the first pile yarn 30 and a second pile yarn 32 are delivered to the fabric formation zone and are passed back and forth between the base fabrics 20, 22 to form a sandwich structure 34. The sandwich structure 34 is thereafter slit by a reciprocating or rotating blade element 36 so as to yield a pair of substantially identical pile fabrics 40, 42 having free standing pile portions formed by the fibers of the first and second pile yarns 30, 32 extending away from the base fabrics 20, 22. As shown, each of the pile fabrics 40, 42 includes portions of both the first pile yarn 30 and the second pile yarn 32.

Of course, it is to be understood that the fabric formation apparatus 10 is exemplary only in that virtually any other pile forming apparatus as may be known to those of skill in the art may likewise be used. By way of example only, and not limitation other pile forming practices may include single needle bar knitting, velour weaving, tufting, stitch bonding, and the like.

Figure 2:
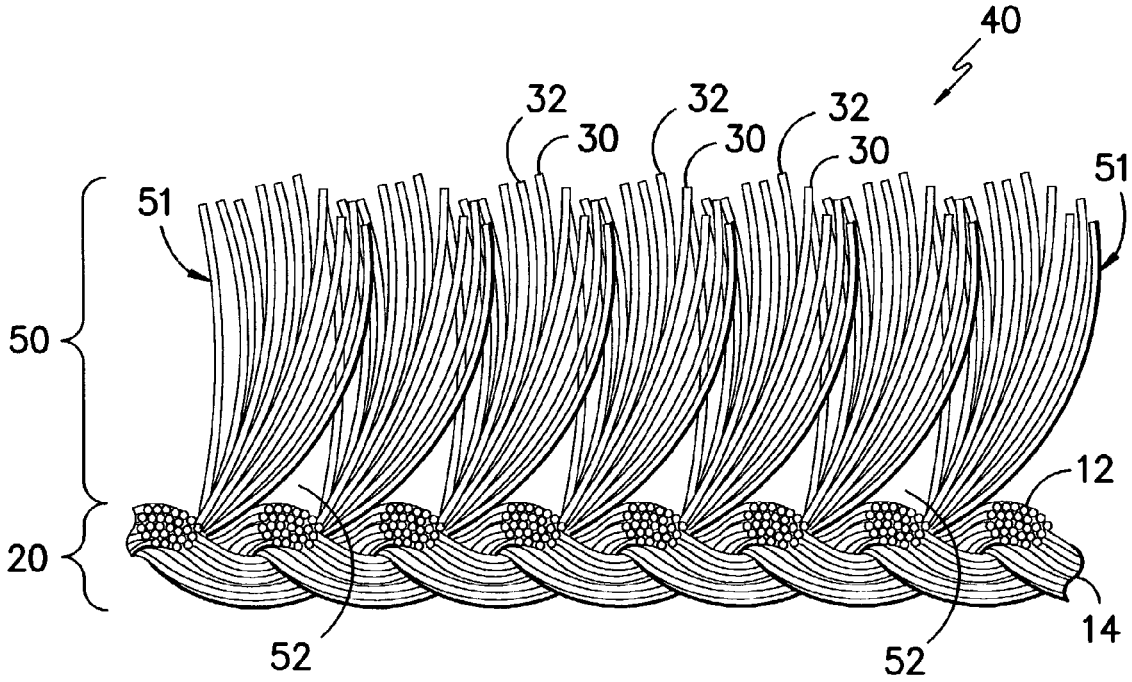
FIG. -2- PRIOR ART
FIG. 2 illustrates a cut-away cross-section of a typical prior art pile fabric formed using flat (i.e. untextured) pile yarns.

In FIG. 2, there is illustrated a typical prior art pile fabric 40 formed from multi-filament flat (i.e. untextured) yarns. As illustrated, in this prior construction the pile fabric 40 includes a base fabric layer 20 formed by the cooperating ground yarns 12, 14 and a outwardly projecting pile layer 50 formed by an arrangement of tufts 51 including the cooperating pile-forming fibrous elements of pile yarns 30, 32. As shown, in such a construction the pile-forming fibrous elements forming the pile portion 50 are generally of a substantially equivalent height across the surface of the pile fabric 40. In particular, it has been found that such prior fibrous elements typically have an average variation in height of less than about 20%. Moreover at the base of the prior art pile fabric 40, there are peak shaped voids 52 between the tufts 51 projecting away from the base fabric 20. As will be appreciated, upon bending the pile fabric 40 around a sharp radius such as a bolster portion of a chair or the like, the substantially uniform height pile-forming fibrous elements in the tufts may act in concert with one another thereby readily revealing the voids at the radius of curvature.

As will be appreciated by those of skill in the art, multi-filament yarn is formed from a multiplicity of discrete filaments which are combined together in a defined manner to yield a desired yarn construction having a predefined cross-sectional geometry and diameter. The individual filaments typically are formed from collections of long chain polymers which are expelled from a melt through a spinneret so as to impart only a partial degree of orientation to the molecular chains. Thus, the filaments (and the yarns formed therefrom) are only partially oriented in the longitudinal direction. Accordingly, such yarns typically are suitable for further longitudinal orientation by being passed through a yarn drawing operation.

According to one contemplated practice the present invention utilizes the ability to impart different characteristics to a yarn during drawing to yield at least two distinct sets of pile-forming fibrous elements for formation into a pile fabric. According to one contemplated practice, due to different drawing procedures used on the pile yarn groups prior to fabric formation, different levels of heat shrinkage potential are imparted to the pile-forming fibrous elements thereby causing one set of pile-forming fibrous elements to preferably shrink relative to another set of pile-forming fibrous elements when subjected to finishing and/or dyeing heat treatments. In addition, the pile forming fibrous elements which undergo shrinkage also bloom laterally outward so as to act substantially like self crimping fibers. This lateral blooming results in a substantially reduced void area between the tufts in comparison to standard pile products formed from flat yarns. Such reduced void area corresponds to enhanced surface coverage across the fabric base.

Figure 3A:
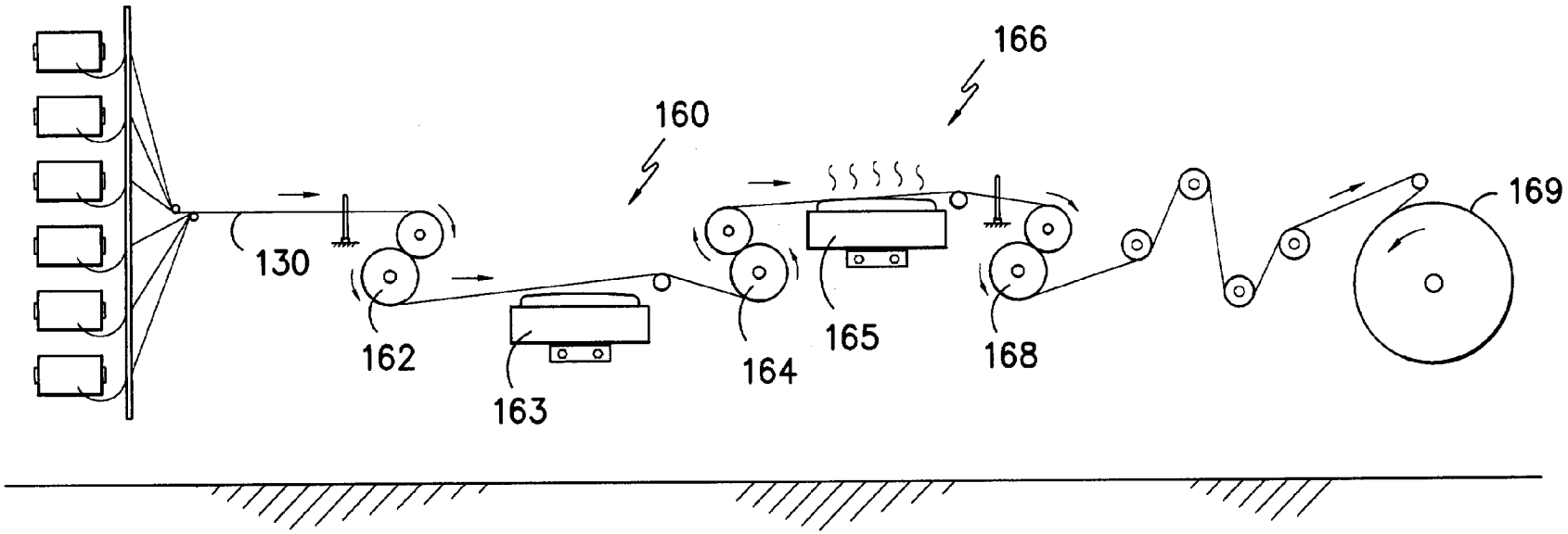
FIGS. 3A and 3B illustrate schematically a first practice for imparting variable shrink characteristics to a set of pile forming yarns.
Figure 3B:
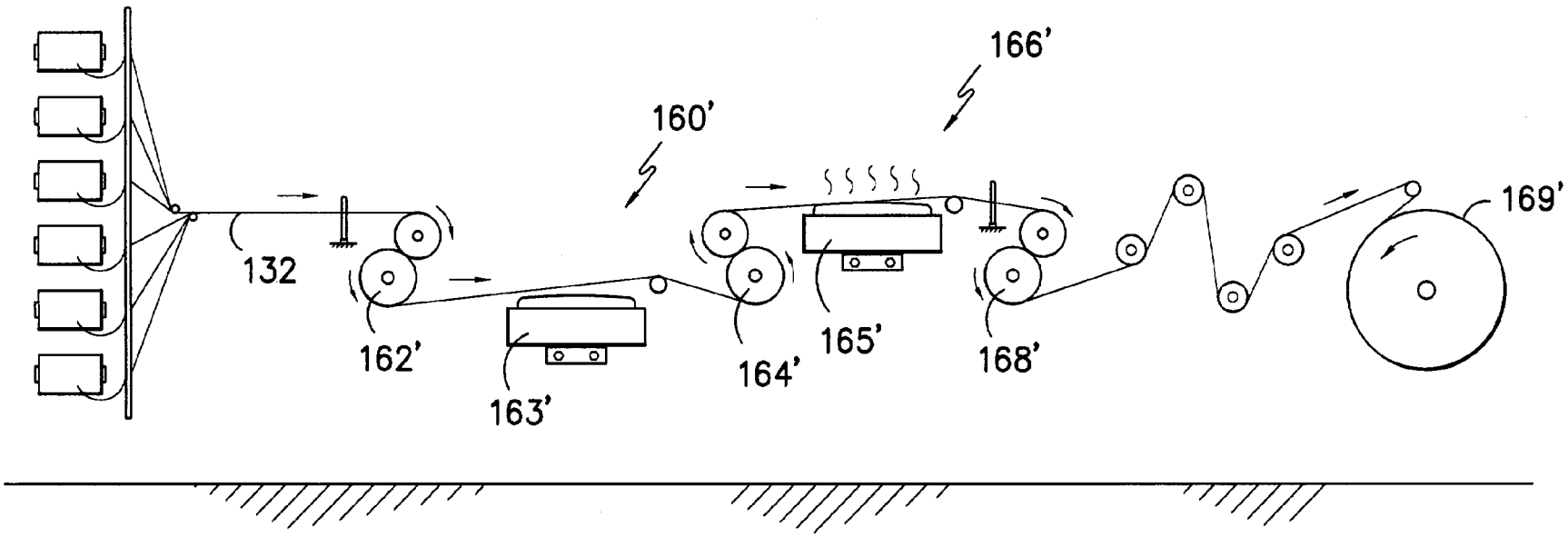

A first exemplary procedure for applying variable heat shrinkage characteristics to pile forming yarns is illustrated through simultaneous reference to FIGS. 3A and 3B. As illustrated, a first sheet of pile yarns 130 is passed to a first draw zone 160 between a first set of nip rolls 162 and a second set of nip rolls 164. As shown, if a heater 163 is present in the first draw zone, such heater is preferably not activated. In this process the second set of nip rolls 164 is operated at a faster speed than the first set of nip rolls 162 thereby tensioning the yarns 130 through the draw zone and causing further elongation and orientation of the yarns 130. As shown, the draw zone 160 is not heated, thus the yarns 130 are referred to as a cold drawn yarn. Following the drawing process, the yarns 130 are thereafter passed through a heating zone 166 including a heater 165 between the second set of nip rolls 164 and a third set of nip rolls 168. In the illustrated practice the third set of nip rolls 168 is operated at a slower speed than the second set of nip rolls 164 thereby giving rise to an over-feed condition in the heating zone 166. The over-feed is preferably in the range of about 8% to about 30% and will most preferably be about 16%.

Due to the over-feed condition at the heating zone 166, the yarn is allowed to substantially relax thereby shortening to substantially the full degree permitted by the application of heat. That is, the yarn 130 is maintained for a time and at a temperature sufficient to constrict the yarn substantially to the full extent permitted such that upon application of subsequent high temperature environments, the yarn 130 does not shrink to a substantial additional degree. In order to achieve this result, the heating zone 166 is maintained at a temperature sufficient to heat the yarn above its glass transition temperature ($T_g$). According to one potentially preferred practice for polyester, the heating zone 166 is maintained at a temperature of about 215 Celsius and the dwell time of the yarns 130 within the heating zone 166 is preferably in the range of about 0.04 to about 0.1 seconds. The yarns 130 are thereafter delivered to a takeup 169 for subsequent incorporation into the pile of a fabric.

According to the practice illustrated in FIGS. 3A and 3B, a second sheet of yarns 132 which are substantially identical to the yarns 130 is passed through a draw zone 160' between a first set of nip rolls 162' and a second of nip rolls 164'. In this practice the second set of nip rolls 164' is operated at a faster speed than the first set of nip rolls 162' thereby causing a lengthening and further orientation of the yarns 132. Since the draw zone 160' is operated in an unheated condition with heater 163' turned off, the yarns 132 are likewise considered cold drawn yarns. Following the cold drawing of the pile yarns 132, the pile yarns 132 are thereafter passed through a heating zone 166' over heater 165' between the second set of nip rolls 164' and a third set of nip rolls 168'. The second set of nip rolls 164' is operated at substantially the same speed as the third set of nip rolls 168'. Thus, the pile yarn is held in a substantially neutral tensioned state through the heating zone 166'. In this process, the heating zone 166' is preferably operated at a temperature such that the yarn temperature is not elevated to a temperature above the glass transition temperature ($T_g$) for a prolonged period of time so as to relieve internal stresses within the yarn but without imparting substantial shrinkage. That is, while the yarn may be raised above the glass transition temperature for brief periods, it is generally held below this temperature. Thus, the yarns 132 are not fully relaxed upon exiting the heating zone 166' and therefore are susceptible to further shrinkage upon application of heat during subsequent processing. The yarns 132 are thereafter delivered to a takeup 169' for subsequent incorporation into the pile of a fabric.

Figure 4A:
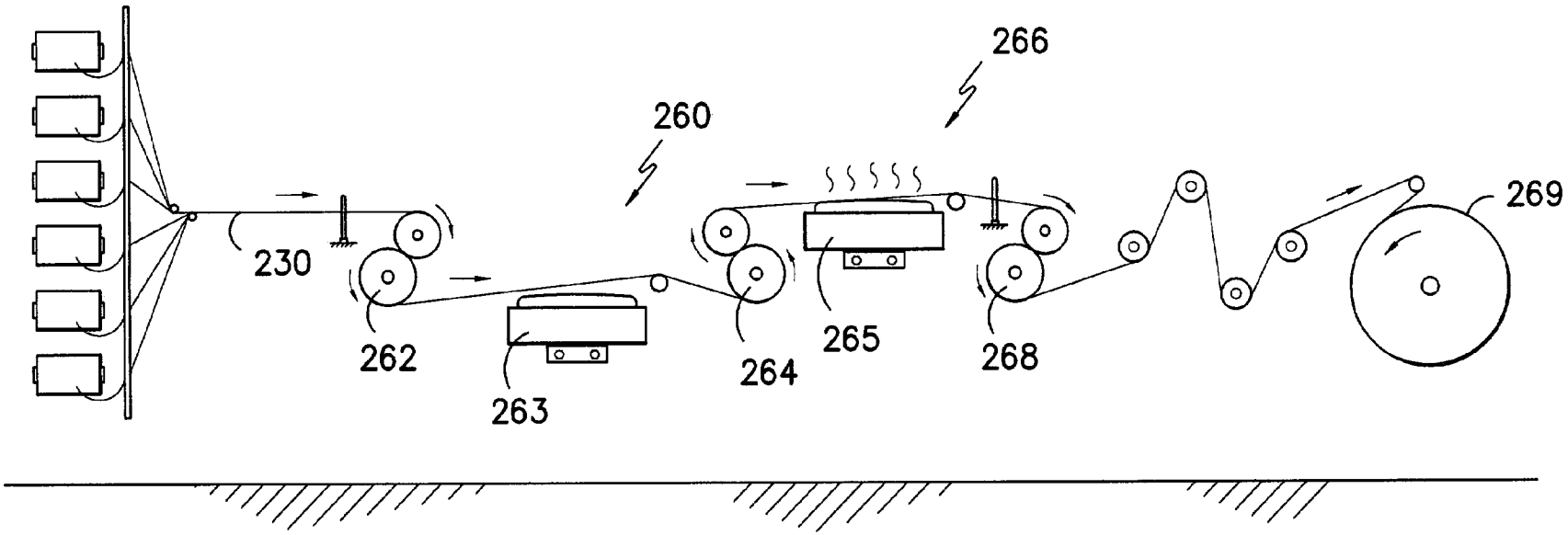
FIGS. 4A and 4B illustrate schematically a second practice for imparting variable shrink characteristics to a set of pile forming yarns.
Figure 4B:
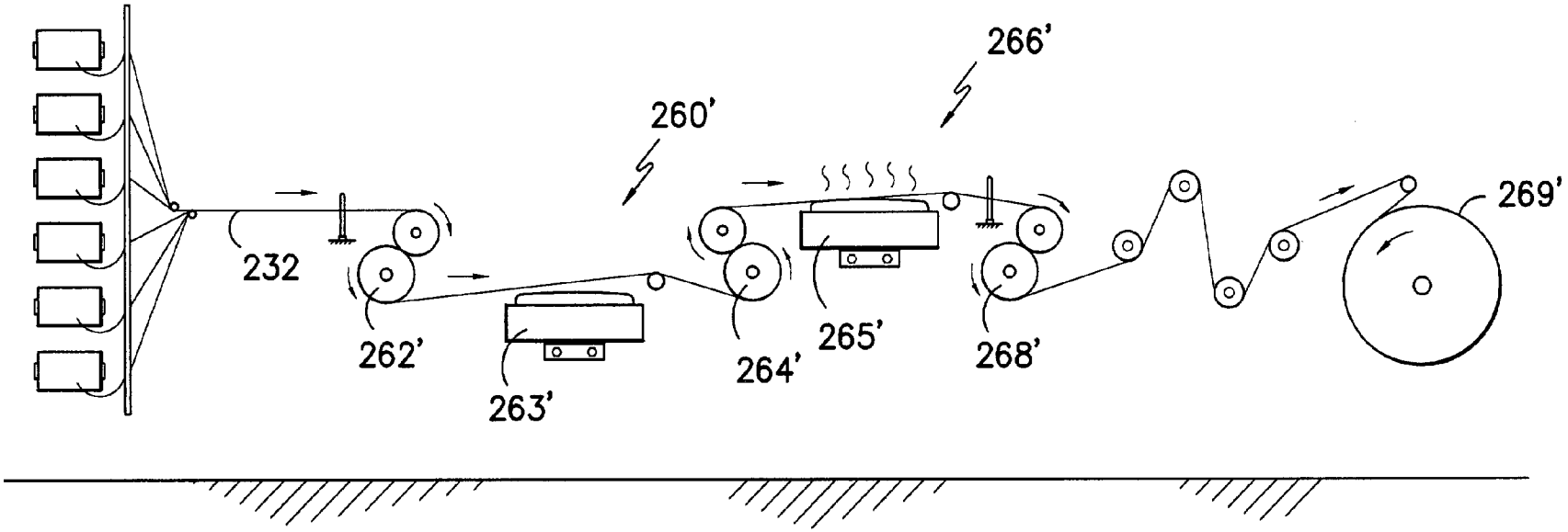

In FIGS. 4A and 4B an alternative process is illustrated wherein like elements to those previously described are designated by like reference numerals within a 200 series. As shown, in the process of FIGS. 4A and 4B the first sheet of pile yarns 230 is cold drawn across the draw zone 260 and is thereafter relaxed in an over-feed condition within the heating zone 266 exactly as in FIG. 3A. However, in the exemplary process illustrated in FIGS. 4A and 4B, the second sheet of pile yarns 232 is treated differently. In particular, in the process illustrated in FIG. 4B, the first and second nip rolls 262', 264' are operated at substantially the same speed while the third set of nip rolls 268' is operated at a higher speed. Thus, the yarns 232 are drawn to an extended length while in the heating zone 266'. The yarn 232 is thus considered a hot drawn yarn. In such a practice, the heating zone 266' is preferably maintained at a temperature such that the yarn is generally maintained below its glass transition temperature ($T_g$) such that the yarn temperature is not elevated to a temperature above the glass transition temperature ($T_g$) for a prolonged period of time. That is, while the yarn may be raised above the glass transition temperature for brief periods, it is generally held below this temperature. Thus, the yarns 132 are not fully relaxed upon exiting the heating zone 166' and therefore are susceptible to further shrinkage upon application of heat during subsequent processing. In this regard it is to be noted that in order to improve efficiency the actual temperature of the heating zone may be above the glass transition temperature provided the dwell time of the yarn is such that the yarn itself does not exceed this temperature for prolonged periods. As will be appreciated, upon exiting the heating zone 266, the pile yarns 230 will be substantially fully shrunk and will not be susceptible to substantial further shrinking upon the application of heat. However, since the yarns 232 have not undergone relaxation, such yarns will be susceptible to heat shrinkage upon subsequent heat application.

According to one contemplated practice, at least two groups of pile yarns with different shrinkage character are used in the formation of a pile fabric wherein one group of pile yarns is characterized by a retained residual shrinkage potential (i.e. the amount it can be further shrunk upon heat application) which is greater than the other yarn group. Preferably, the difference in retained residual shrinkage potential between the two yarn groups is between about 3% and 40%. Most preferably, the yarn group with the lower shrinkage potential will be characterized by a retained residual shrinkage potential of about 3% or less and the yarn group with the higher shrinkage potential will be characterized by a retained residual shrinkage potential of about 6% to about 43%. Of course, it is to be understood that differential shrinkage characteristics may be achieved by means other than drawing partially oriented yarns in different manners. Accordingly, by way of example only, it is contemplated that other yarns such as fully oriented yarns with variable shrinkage character may be used if desired.

The pile yarns may be formed into a pile fabric using a suitable technique such as a double needle bar knit process described previously with respect to the prior art. According to one potentially preferred practice, in such a pile fabric each tuft within the pile portion of the fabric includes pile-forming fibrous elements from both high shrinkage and low shrinkage yarns. Following fabric formation, the pile fabric is thereafter passed through a standard tenter and/or other heat treatment apparatus such as a heated dye bath or the like wherein the formed fabric including the outwardly projecting pile-forming fibrous elements are subjected to an elevated temperature. In practice this elevated temperature is preferably such that the pile is raised above its glass transition temperature to effect shrinkage of pile-forming fibrous elements from yarns with high retained shrinkage potential. By way of example only and not limitation, it has been found that subjecting a polyester pile fabric to a temperature of about 415 Fahrenheit for a period of about 2 minutes following formation permits the desired contraction of the high shrinkage pile yarns.

One exemplary fabric construction 140 which results from the post formation yarn shrinkage is illustrated in FIG. 5. As illustrated, the pile fabric 140 includes a base or ground fabric 120 and a pile portion 150 projecting away from the base fabric 120.

In the illustrated construction the pile portion 150 includes a multiplicity of pile forming tufts 151 each including a first grouping of pile-forming fibrous elements 180 and at least a second longer grouping of pile-forming fibrous elements 185. As will be appreciated, the first grouping of pile-forming fibrous elements 180 is formed from yarn with high residual shrinkage potential such as yarn which was not fully heat shrunk prior to formation into the fabric construction 140. Thus, upon application of heat during finishing the pile-forming fibrous elements 180 undergo contraction towards the ground fabric 120 and simultaneously bloom outwardly within the lower region of the pile portion 150 so as to close voids between the tufts. Conversely, the longer pile-forming fibrous elements 185 are formed from yarns with relatively low residual shrinkage potential such as yarns which were substantially fully heat shrunk prior to formation into the fabric construction 140. Thus, during the post formation heat treatment, the pile-forming fibrous elements 185 do not undergo substantial further shrinkage.

As illustrated, the shortened and bloomed pile-forming fibrous elements 180 serve to define a surface covering in the region immediately above the base fabric 120. The pile-forming fibrous elements 185 which do not undergo substantial shrinkage during post formation heat treatment remain standing at an extended height above both the base fabric 120 as well as above the shortened and bloomed pile-forming fibrous elements. The tips of the pile-forming fibrous elements 185 projecting above the shortened pile-forming fibrous elements 180 thus define a contact surface of relatively dispersed yarn tips across the fabric construction 140. Due to the relatively dispersed nature of the terminal ends of these yarns, they impart a soft feel to a user.

As will be appreciated, within the tufts 151 the intra-tuft population density of pile-forming fibrous elements (short fibrous elements 180 plus longer fibrous elements 185) is substantially greater at the lower portion of the tufts than at the upper portion of the tufts. Moreover, the change in intra-tuft fiber population density is substantially localized at the position along the tufts where the shorter fibrous elements 180 end. That is, the intra-tuft fiber population density along the length of the tufts from the base 120 to the outermost tips includes at least one localized step-wise decrease at a position below the tips corresponding to the termination of the shorter fibrous elements 180. It has been found that in such a construction the yarns of the pile fabric perform in a cooperative manner wherein the shortened bloomed fibrous elements 180 provide the desired surface cover characteristics while the outstanding extended length fibrous elements 185 provide substantial tactile softness.

In order to provide this desired cooperative performance, in the final fabric construction the shorter bloomed fibers will preferably be on average at least about 25% shorter than the fibers in the taller group and will more preferably be on average at least 30%–45% shorter than the fibers in the taller group. Moreover, there is preferably about a 5% to about a 25% reduction in fiber population density along the tufts at locations more than about 75% along the tuft length above the base fabric. That is, the individual tufts preferably thin out by at least 5% to 25% in about the final 75% of their length.

The invention may be further understood through reference to the following non-limiting examples.

EXAMPLE 1

A 44 gauge double needle bar knit stitch fabric was formed in a sandwich structure at a six bar construction with ground yarns (forming the fabric base) carried in bars 1, 2, 5 and 6 and pile yarns carried in bars 3 and 4. The pile-forming yarns were characterized by variable shrinkage characteristics. The ground yarns carried in bars 1 and 6 were 100 denier 34 filament semi-dull round false twist textured polyester with post texturing entanglement. The ground yarns carried in bars 2 and 5 were 100 denier 36 filament spun drawn flat polyester yarns. Two different pile-forming yarns were used with each yarn being fully threaded through both bars 3 and 4 such that each pile tuft contains both pile-forming yarns. The first pile-forming yarn which was characterized by residual heat shrinkage potential of about 1 to 2 percent was a 160 denier 48 filament partially oriented full dull polyester yarn formed from filaments with a lobal wave shaped cross-section. This yarn was cold drawn followed by overfeed heated relaxation to 111 denier before fabric formation according to the process illustrated and described in relation to FIG. 3A above. The second pile forming yarn which was characterized by residual heat shrinkage potential of about 6 to about 8.5 percent was identical to the first pile-forming yarn but was drawn to 94 denier prior to fabric formation without overfeed heated relaxation according to the process illustrated and described in relation to FIG. 3B above.

Formation and processing parameters for the fabric of this example are set forth in Table 1 below.

TABLE 1

| | |
|---|---|
| Gap Setting | 4.0 mm |
| Stitch Type | 6 Bar Knit Stitch |

TABLE 1-continued

| | |
|---|---|
| Threading | Full Bar With an End From Bar 3 and Bar 4 Doubled in the Same Needle |
| Sandwich Thickness | 170 mm |
| Courses Per Inch (At Slitter Exit) | 38 |
| Wales Per Inch (At Slitter Exit) | 22.5 |
| Greige Brush | Yes (3 brushes) |
| Tenter Heat Set Temperature | 410 Fahrenheit |
| Tenter Heat Set Dwell Time | 2 minutes |
| Dyeing (After Heat Set) | Pressure Jet Dyed with Top Temperature of 280 Fahrenheit at 30 minutes |
| Tenter Drying Temperature | 280–300 Fahrenheit |
| Drying Brush | Yes |
| Finish Brush | Yes (2 brushes) |
| Finish IR Heat | Yes (250 Fahrenheit) |
| Finish Steam | Yes |
| Courses Per Inch (Finished Fabric) | 35 |
| Wales Per Inch (Finished Fabric) | 23.5 |

Figure 6:
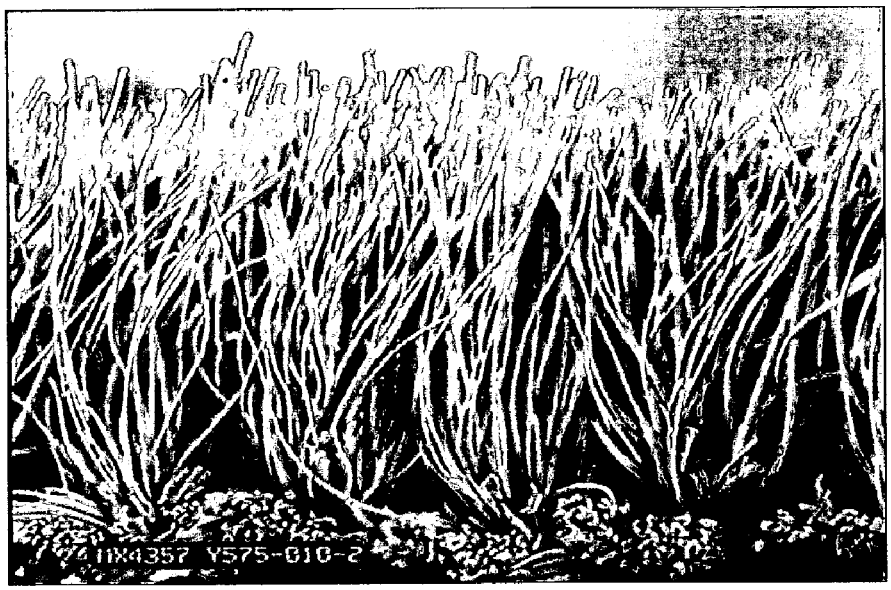
FIG. 6 is a cross-sectional photomicrograph of a finished pile fabric wherein the fibers within the pile have a lobal wave cross section and are of variable height and bloomed to provide enhanced surface coverage across the base.

A cross-sectional photomicrograph of the finished fabric is provide at FIG. 6.

The differential height of the pile filaments from the pile-forming yarn having high residual shrinkage relative to the pile filaments from the pile forming yarn having low residual shrinkage was measured by comparing the height difference between a number of pairs of randomly selected tall filaments from the yarn with low residual shrinkage and short filaments from the yarn with high residual shrinkage within the pile. This differential height between the tall fibers and the short fibers was found on average to be about 0.52 mm. The average height of the tall fibers defining the overall pile height was about 1.34 mm. Thus, on average, the fibers in the shorter group were about 39% shorter than the fibers in the taller group.

EXAMPLE 2

A 44 gauge double needle bar knit stitch fabric was formed in a sandwich structure at a six bar construction with ground yarns (forming the fabric base) carried in bars 1, 2, 5 and 6 and pile yarns carried in bars 3 and 4. The pile-forming yarns were characterized by variable shrinkage characteristics. The ground yarns carried in bars 1 and 6 were 100 denier 34 filament semi-dull round false twist textured polyester with post texturing entanglement. The ground yarns carried in bars 2 and 5 were 100 denier 36 filament semi-dull round spun drawn flat polyester. Two pile-forming yarns were used such that each pile tuft contains both pile-forming yarns.

The bar 3 yarn which was characterized by residual heat shrinkage potential of about 7 to about 8.5 percent was a 175 denier 48 filament partially oriented full dull round polyester yarn formed from filaments with a substantially circular cross-section and cold drawn to 100 denier before fabric formation according to the process illustrated and described in relation to FIG. 3B above. The bar 4 yarn which was characterized by residual heat shrinkage potential of about 1.2 to about 2.1 percent was identical to the bar 3 yarn but was cold drawn to 118 denier prior to fabric formation according to the process illustrated and described in relation to FIG. 3A above with overfeed of about 16 percent in the heating zone after drawing to effect shrinkage prior to fabric formation.

Formation and processing parameters for the fabric of Example 2 are set forth in Table 2 below.

TABLE 2

| | |
|---|---|
| Gap Setting | 4.0 mm |
| Stitch Type | 6 Bar Knit Stitch |
| Threading | Full Bar With an End From Bar 3 and Bar 4 Doubled in the Same Needle |
| Sandwich Thickness | 176 mm |
| Courses Per Inch (At Slitter Exit) | 40 |
| Greige Brush | Yes (3 brushes) |
| Tenter Heat Set Temperature | 410 Fahrenheit |
| Tenter Heat Set Dwell Time | 2 minutes |
| Dyeing (After Heat Set) | Pressure Jet Dyed with Top Temperature of 280 Fahrenheit at 30 minutes |
| Tenter Drying Temperature | 280–300 Fahrenheit |
| Drying Brush | Yes |
| Finish Brush | Yes (2 brushes) |
| Finish IR Heat | Yes (250 Fahrenheit) |
| Finish Steam | Yes |
| Courses Per Inch (Finished Fabric) | 36 |

Figure 7:
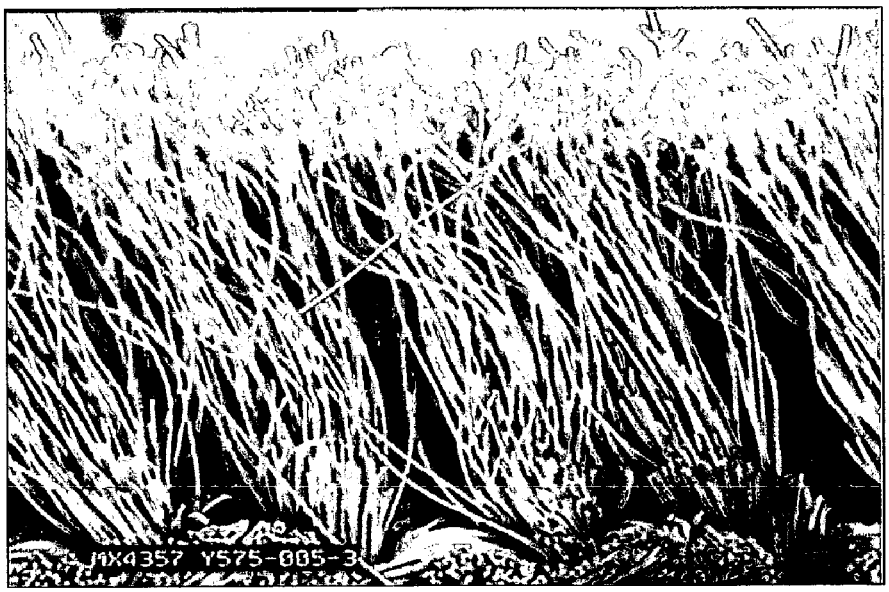
FIG. 7 is a cross-sectional photomicrograph of a finished pile fabric wherein the fibers within the pile have a round cross section and are of variable height and bloomed to provide enhanced surface coverage across the base.

A cross-sectional photomicrograph of the finished fabric is provide at FIG. 7.

The differential height of the pile filaments from the bar 3 pile-forming yarn having high residual shrinkage relative to the pile filaments from the bar 4 pile forming yarn having low residual shrinkage was measured by comparing the height difference between a number of pairs of randomly selected tall filaments from the bar 4 yarn and randomly selected short filaments from the bar 3 yarn. This differential height between tall fibers and short fibers was on average found to be about 0.48 mm. The average height of the tall fibers defining the overall pile height was about 1.34 mm. Thus, on average, the fibers in the shorter group were about 36% shorter than the fibers in the taller group.

EXAMPLES 3–5 (COMPARATIVE)

In order to evaluate the differences between fabric of the present invention and standard pile fabrics, the pile height differential between pairs of randomly selected fibers was measured in a series of pile fabrics wherein the pile yarn did not have variable shrinkage characteristics. All fabrics were 44 gauge double needle bar knit stitch construction. Finishing was carried out in accordance with the procedures outlined in Example 1.

EXAMPLE 3

Pile Fabric with Pile of Hot Drawn Wave Filament Yarn

This fabric was formed identically to the fabric of Example 1 except that the pile-forming yarn of bars 3 and 4 was a 160 denier full dull wave polyester which was not drawn in the first zone and was hot drawn to 100 denier at 200 Celsius in the second zone of the drawing assembly so as to yield a yarn with about 4 to about 5.5 percent residual shrinkage capacity prior to fabric formation.

The differential height of the pile filaments was measured by comparing the height difference between a number of pairs of randomly selected filaments within the pile. This average differential height was found to be about 0.25 mm. The overall pile height was about 1.34 mm. Thus, on average there was about 19 percent variability in tuft fiber height.

EXAMPLE 4

Pile Fabric with Pile of Cold Drawn Wave Filament Yarn

This fabric was formed identically to the fabric of Example 1 except that the pile-forming yarn of bars 3 and 4 was a 160 denier full dull wave polyester which was cold drawn in the first zone to 100 denier and heat set at 200 Celsius in the second zone of the drawing assembly with no further drawing so as to yield a yarn with about 2.5 to about 3.5 percent residual shrinkage capacity prior to fabric formation.

The differential height of the pile filaments was measured by comparing the height difference between a number of pairs of randomly selected filaments within the pile. This average differential height was found to be about 0.20 mm. The overall pile height was about 1.34 mm. Thus, on average there was about 15 percent variability in tuft fiber height.

EXAMPLE 5

Pile Fabric with Pile of Hot Drawn Round Filament Yarn

This fabric was formed identically to the fabric of Example 2 except that the fabric was heat set in sandwich form prior to slitting so as to replicate typical industrial formation practices for piece dyed double needle bar fabrics. The pile-forming yarn of bars 3 and 4 was a 175 denier full dull round polyester which was not drawn in the first zone of the drawing assembly and was hot drawn to 100 denier at 200 Celsius in the second zone of the drawing assembly so as to yield a yarn with about 4 to about 5.5 percent residual shrinkage capacity prior to fabric formation.

The differential height of the pile filaments was measured by comparing the height difference between a number of pairs of randomly selected filaments within the pile. This average differential height was found to be about 0.07 mm thus indicating substantially no variability.

EXAMPLE 6

Woven Velour Construction

This example illustrates construction parameters for an exemplary woven velour fabric according to the present invention. This construction was formed on a Van de Wiele weaving machine as will be known to those of skill in the art.

The ground warps and filling yarn were 2/150/34 semi-dull heptalobal false twist textured polyester.

The warp 3 (pile-forming) yarn was a 2/150/48 full dull wave polyester. The warp 3 yarn was a 240 denier POY yarn which was not drawn in zone 1 but was hot drawn to 154 denier at a temperature such that the yarn remains generally below the glass transition temperature in the second zone. The drawn yarn leaving the second zone of the drawing apparatus was thereafter doubled through air entanglement jets to yield a yarn having a denier of 311.8.

The warp 4 (pile forming) yarn was a 2/180/48 full dull wave polyester. The warp 4 yarn was a 240 denier POY yarn which was cold drawn to 150 denier in zone 1 and was overfed 16 percent at 215 Celsius in the second zone. The drawn warp 4 yarn leaving the second zone of the drawing apparatus was thereafter doubled through air entanglement jets to yield a yarn having a denier of 359.1.

The weaving machine was threaded at 2 ends/dent in both pile and ground to get ends from warp 3 and warp 4 in the same tuft.

According to one contemplated process, such a woven velour fabric may be finished by slitting followed by brushing (i.e. napping), shearing and heat setting at 390 Fahrenheit with subsequent dyeing at 280 Fahrenheit followed by tenter drying with subsequent brushing and shearing. If desired, the finished fabric may be back coated by latex or the like.

EXAMPLES 7–10

Non-Sandwich Clip Knit Constructions

These examples demonstrate fabrics formed in non-sandwich structures and apply to any single needle bar warp knit construction including POL knit constructions, nap knit constructions and the like. These examples also demonstrate the ability to combine yarns with different cross-sectional fiber geometry to yield desired surface coverage and tactile character.

EXAMPLE 7

High Shrinkage Round Filaments/Low Shrinkage Wave Filaments

A 56 gauge clip kit construction was formed on a single bar rachel knitting machine set up to form a knitted (unfinished) fabric with 53 courses per inch.

Bar 1 pile-forming yarn was a 115 denier yarn having 36 filaments of full dull polyester with round filament cross-section. Prior to fabric formation the bar 1 yarn was cold drawn from 115 denier to 74 denier in the first zone of a draw assembly as previously described and was heat set below the glass transition temperature in the second zone of the draw assembly with no additional drawing such that the yarn had a retained residual shrinkage capacity of 7.8 percent.

Bar 2 pile-forming yarn was a 110 denier yarn having 48 filaments of full dull polyester with a lobal wave shaped filament cross-section. Prior to fabric formation, the bar 2 yarn was cold drawn from 110 denier to 70 denier in the first zone of a draw assembly as previously described. The cold drawn yarn was then overfed 16 percent at 215 Celsius in the second zone of the draw assembly such that the yarn had a retained residual shrinkage capacity of 1.57 percent.

The ground yarns (bar 3 and bar 4) were 115 denier yarn having 36 filaments of full dull polyester with round filament cross-section. Prior to fabric formation the ground yarns were hot drawn to 70 denier at 200 Celsius.

After formation the fabric was conveyed through a tenter (300 Fahrenheit) followed by pad drying (330 Fahrenheit), dyeing (280 Fahrenheit at 30 minutes), napping, heat setting (410 Fahrenheit) and shearing. The finished fabric had a mass per unit area of 13.5 ounces per square yard with 52.5 courses per inch and 37 wales per inch.

EXAMPLE 8

(High Shrinkage Wave Filaments/Low Shrinkage Wave Filaments)

The procedures of Example 7 were repeated in all respects except that the pile was formed from a combination of yarn formed from filaments of wave-shaped cross-section with a retained residual shrinkage capacity of 6.2 percent and yarn formed from filaments of wave-shaped cross-section with a retained residual shrinkage capacity of 1.57 percent. The finished fabric had a mass per unit area of 13.1 ounces per square yard with 51 courses per inch and 37 wales per inch.

EXAMPLE 9

High Shrinkage Round Filaments/Low Shrinkage Round Filaments

The procedures of Example 7 were repeated in all respects except that the pile was formed from a combination of yarn formed from filaments of round cross-section with a retained residual shrinkage capacity of 7.8 percent and yarn formed from filaments of round cross-section with a retained residual shrinkage capacity of 1.52 percent. The finished fabric had a mass per unit area of 14.4 ounces per square yard with 54.5 courses per inch and 37 wales per inch.

EXAMPLE 10

High Shrinkage Wave Filaments/Low Shrinkage Round Filaments

The procedures of Example 7 were repeated in all respects except that the pile was formed from a combination of yarn formed from filaments of wave shaped cross-section having a retained residual shrinkage capacity of 6.2 percent and yarn formed from filaments of round cross-section with a retained residual shrinkage capacity of 1.52 percent. The finished fabric had a mass per unit area of 13.7 ounces per square yard with 53 courses per inch and 37 wales per inch.

Comparative Physical and Performance Evaluations

In order to evaluate surface coverage and tactile feel characteristics a series of evaluations was carried out on various fabric constructions according to the present invention as described above as well as on pile fabrics utilizing more complex false twist textured yarns in the pile.

Surface Coverage Evaluation:

Fabric samples were produced and prepared by cutting the edge with a razor to reveal the tufts in a coarse line. A video microscope (HIROX Hi-Scope Compact Micro Vision System Model KH-2200) was used to capture the image of the tufts of each fabric sample. Sample images were gathered at various locations to provide better statistical representation. Using Adobe PHOTOSHOP version 6.0 software, photo images corresponding to 1 inch of fabric edge were transferred into IMAGE PRO PLUS version 4.5.029 software by Media Cybernetics. Using IMAGE PRO PLUS, the void areas between the fabric tufts (as seen from the edge view) were traced and filled in with bright white for the image analyzer to pick out. The area of each filled in region between tufts was then calculated by the software. Ten files for each fabric sample were then averaged to yield an average void area between tufts.

Surface Friction Evaluation:

In order to evaluate relative softness, the fabric samples were subjected to the Kawabata surface friction measurements wherein a sample of fabric is moved back and forth under constant tension while underneath and in contact with a frictional contactor. The frictional drag force is measured while the contactor is under constant force normal to the fabric surface. A mean coefficient of friction (miufor) is calculated for forward movement of the sample as the integral of the instantaneously measured friction over a defined distance in the forward direction. A mean coefficient of friction (miuback) is also calculated for backward movement of the sample as the measured friction over a defined distance in the forward direction. A mean coefficient of friction (miuback) is also calculated for backward movement of the sample as the integral of the instantaneously measured friction over a defined distance in the backward direction. An overall dimensionless mean coefficient of friction (MIU) is then calculated according to the following formula:

$$MIU=(miufor+miuback)/2.$$

As will be appreciated, by measuring friction in both directions variability due to pile orientation is eliminated.

Compression Evaluation:

In order to evaluate fabric compressibility the fabric samples were subjected to the Kawabata compression measurements wherein the compression of the fabric is measured in relation to resistive forces experienced by a plunger having a certain surface area as the plunger is moved toward and away from a fabric sample in a direction perpendicular to the fabric. Compression is calculated as a percentage according to the following formula:

$$\text{COMPRESSION RATIO} = \frac{100 \times (T\text{diff}/T\text{min})}{\text{Fabric Weight}}$$

Wherein Tmin is the thickness as measured at application of a nominal baseline force of 0.5 grams force per square cm and Tdiff is the total thickness change during compression (mm) as measured between Tmin and application of a force of 50 grams force per square cm. As will be appreciated, in calculating the compression ratio, fabric weight is divided out to eliminate variability based on weight.

The measured parameters for various fabric samples are set forth in the following table.

| Sample | Void Area ($mm^2$) | Surface Friction | Compression Ratio |
|---|---|---|---|
| Example 1 | 0.01836 | 0.34 | 0.957 |
| Example 2 | 0.05896 | 0.37 | 0.549 |
| Example 3 | 0.03352 | 0.413 | 0.46 |
| Example 4 | 0.0486 | 0.465 | 0.482 |
| Example 5 | 0.2628 | 0.496 | 0.234 |
| False twist textured In one pile bar and hot warp draw yarn in the other pile bar | 0.02280 | 0.425 | 0.51 |
| False twist texture yarn in both pile bars | | 0.417 | 0.862 |
| Example 7 | 0.040044 | 0.369 | 0.361 |
| Example 8 | 0.02663 | 0.414 | 0.518 |
| Example 9 | 0.040006 | 0.399 | 0.413 |
| Example 10 | 0.050901 | 0.416 | 0.462 |
| False twist textured pile yarn (round) in combination with hot drawn wave filament yarn | 0.017991 | 0.45 | 0.606 |

This data indicates that the samples of Examples 1, 2, and 7–10 exhibited substantially reduced void area in comparison to conventional pile fabrics formed from fibers with similar cross sectional geometries. These characteristics matched favorably with fabrics utilizing false twist textured yarns. Moreover, these fabrics had generally low surface friction and high compression which reflects good softness.

Of course, it is also contemplated that any number of other practices may be utilized to provide the desired variable height pile yarn arrangement. Thus, while the invention has been illustrated and described in relation to certain potentially preferred embodiments, constructions, and procedures, it is to be understood that such embodiments, constructions and procedures have been exemplary and illustrative only and that the present invention is in no event to be limited thereto. Rather, it is contemplated that modifications and variations embodying the principles of this invention will no doubt occur to those of skill in the art. Thus, it is intended that the present invention shall extend to all such modifications and variations as may incorporate the broad principles of the invention within the full spirit and scope thereof.

What is claimed is:

1. A pile fabric comprising a base portion and a pile portion, wherein the pile portion comprises a plurality of tufts comprising a plurality of non-textured pile forming fibers extending away from the base portion and wherein a portion of said pile forming fibers comprises fibers having a multi-lobal wave cross sectional geometry and wherein said pile forming fibers provide a level of surface coverage across said base portion such that when said base and said tufts are viewed from an edge perspective the average open void area between tufts is less than about 0.030 $mm^2$.

2. The invention as recited in claim 1, wherein said pile fabric is about a 44 gauge construction fabric.

3. The invention as recited in claim 1, wherein said pile forming fibers provide a level of surface coverage across said base portion such that when said base and said tufts are viewed from an edge perspective the average open void area between tufts is less than about 0.025 $mm^2$.

4. The invention as recited in claim 3, wherein said pile fabric is about a 44 gauge construction fabric.

5. The invention as recited in claim 1, wherein said pile forming fibers provide a level of surface coverage across said base portion such that when said base and said tufts are viewed from an edge perspective the average open void area between tufts is less than about 0.020 $mm^2$.

6. The invention as recited in claim 5, wherein said pile fabric is about a 44 gauge construction fabric.

7. A pile fabric comprising a base portion and a pile portion, wherein the pile portion comprises a plurality of tufts comprising a plurality of non-textured pile forming fibers extending away from the base portion and wherein a portion of said pile forming fibers comprises fibers having a round cross sectional geometry and wherein said pile forming fibers provide a level of surface coverage across said base portion such that when said base and said tufts are viewed from an edge perspective the average open void area between tufts is less than about 0.15 $mm^2$.

8. The invention as recited in claim 7, wherein said pile fabric is about a 44 gauge construction fabric.

9. The invention as recited in claim 7, wherein said pile forming fibers provide a level of surface coverage across said base portion such that when said base and said tufts are viewed from an edge perspective the average open void area between tufts is less than about 0.10 $mm^2$.

10. The invention as recited in claim 9, wherein said pile fabric is about a 44 gauge construction fabric.

11. The invention as recited in claim 7, wherein said pile forming fibers provide a level of surface coverage across said base portion such that when said base and said tufts are viewed from an edge perspective the average open void area between tufts is less than about 0.075 $mm^2$.

12. The invention as recited in claim 11, wherein said pile fabric is about a 44 gauge construction fabric.

13. A pile fabric comprising a base portion and a pile portion projecting away from the base portion, wherein the pile portion comprises a plurality of individual tufts comprising a first group of non-textured pile forming fibers having an average height relative to the base portion and at least a second group of non-textured pile forming fibers having an average height relative to the base portion which is greater than the average height of the first group, and wherein said tufts comprise a tuft base disposed adjacent to the base portion of the fabric and a plurality of tuft tips defining an upper surface of the fabric and wherein at least a portion of said tufts are characterized by a variable population density of pile forming fibers along the length of said tufts such that said tufts have a first number of pile forming fibers at the tuft base and such that said tufts are characterized by a reduction in the number of pile forming fibers per tuft along the length of said tufts such that the number of pile forming fibers is reduced to not more than about 90 percent of said first number of pile forming fibers at locations along the tufts about 75 percent and greater along the length of said tufts as measured from the tuft base to the tuft tips.

14. The invention as recited in claim 13, wherein said tufts are characterized by a reduction in the number of pile forming fibers per tuft along the length of said tufts such that the number of pile forming fibers is reduced to not more than about 85 percent of said first number of pile forming fibers at locations along the tufts about 75 percent and greater along the length of said tufts as measured from the tuft base to the tuft tips.

15. The invention as recited in claim 13, wherein said tufts are characterized by a reduction in the number of pile forming fibers per tuft along the length of said tufts such that the number of pile forming fibers is reduced to not more than about 80 percent of said first number of pile forming fibers at locations along the tufts about 75 percent and greater along the length of said tufts as measured from the tuft base to the tuft tips.

16. The invention as recited in claim 13, wherein both the first group of pile forming fibers and the second group of pile forming fibers are characterized by substantially uniform cross-sectional geometry along their length.

17. The invention as recited in claim 16, wherein said cross-sectional geometry is round.

18. The invention as recited in claim 16, wherein said cross-sectional geometry is in the form of a multi-lobal wave.

19. The invention as recited in claim 13, wherein the first group of pile forming fibers and the second group of pile forming fibers are of the same material.

20. The invention as recited in claim 19, wherein said material is selected from the group consisting of polyester, nylon and polypropylene.

21. The invention as recited in claim 13, wherein said pile fabric is a knit fabric.

22. The invention as recited in claim 13, wherein said pile fabric is a woven velour fabric.

23. The invention as recited in claim 13, wherein at least a portion of the first group of pile forming fibers have a different cross-sectional geometry than at least a portion of the second group of pile forming fibers.

24. A method of forming a pile fabric, the method comprising the steps of:

forming a first multi-filament pile yarn and at least a second multi-filament pile yarn into a plurality of tufts extending across a base portion such that the tufts and base portion define a fabric structure and wherein the first pile yarn has a retained residual shrinkage potential at least 3 percentage points higher than the second pile yarn; and heating the fabric structure to a level above the glass transition temperature of at least the first pile yarn such that the first pile yarn preferentially shrinks towards the base portion relative to the second pile yarn.

25. The invention as recited in claim 24, wherein at least one of the first pile yarn and the second pile yarn is a partially oriented drawn flat yarn.

26. The invention as recited in claim 24, wherein both the first pile yarn and the second pile yarn are partially oriented drawn flat yarns.

27. The invention as recited in claim 26, wherein both the first pile yarn and the second pile yarn are partially oriented cold drawn flat yarns.

28. The invention as recited in claim 26, wherein the first pile yarn is a partially oriented hot drawn flat yarn and the second pile yarn is a partially oriented cold drawn flat yarn.

29. The invention as recited in claim 24, wherein both the first pile yarn and the second pile yarn have a round cross-sectional geometry.

30. The invention as recited in claim 24, wherein both the first pile yarn and the second pile yarn have a multi-lobal wave cross-sectional geometry.

31. The invention as recited in claim 1, wherein the first pile yarn and the second pile yarn are of the same material.

32. The invention as recited in claim 31, wherein said material is selected from the group consisting of polyester, nylon and polypropylene.

33. The invention as recited in claim 24, wherein said pile fabric is a knit fabric.

34. The invention as recited in claim 33, wherein said pile fabric is a double needle bar knit fabric.

35. The invention as recited in claim 33, wherein said pile fabric is a clip knit fabric.

36. The invention as recited in claim 24, wherein said pile fabric is a woven velour fabric.

37. The invention as recited in claim 24, wherein after heating the fabric structure to a level above the glass transition temperature of at least the first pile yarn, the first pile yarn is on average characterized by a height at least 25 percent less than the height of the second pile yarn.

38. The invention as recited in claim 24, wherein after heating the fabric structure to a level above the glass transition temperature of at least the first pile yarn, the first pile yarn is on average characterized by a height at least 30 percent less than the height of the second pile yarn.

39. The invention as recited in claim 24, wherein after heating the fabric structure to a level above the glass transition temperature of at least the first pile yarn, the first pile yarn is on average characterized by a height at least 35 percent less than the height of the second pile yarn.

40. The invention as recited in claim 24, wherein the first pile yarn has a different cross-sectional geometry than the second pile yarn.

41. A method of forming a pile fabric comprising a base portion and a pile portion projecting away from the base portion, wherein the pile portion comprises a plurality of tufts extending away from the base portion, the method comprising the steps of:

providing a first non-textured multi-filament pile forming yarn and at least a second non-textured multi-filament pile forming yarn;

drawing both the first pile forming yarn and the second pile forming yarn to a reduced denier;

treating one of the pile forming yarns with heat under relaxed conditions subsequent to drawing to form a preshrunk pile forming yarn characterized by a level of residual shrinkage potential of not greater than about 3 percent;

holding the level of residual shrinkage potential in the other of the pile forming yarns at a level of at least 6 percent;

subsequent to the previous steps, forming both the preshrunk pile forming yarn and the other of the pile forming yarns into a plurality of tufts extending away from a fabric base such that the base and the tufts define a fabric structure; and heating the fabric structure such that the other of the pile forming yarns shrinks towards the base preferentially relative to the preshrunk yarn such that at least a portion of said tufts comprise a first group of pile forming fibers having an average height relative to the base portion and at least a second group of pile forming fibers having an average height relative to the base portion which is greater than the average height of the first group.

42. The invention as recited in claim 41, wherein at least a portion of the first group of pile forming fibers is characterized by a height at least 30 percent less than the average height of the second group.

* * * * *